US005954454A

United States Patent [19]

Bennett

[11] Patent Number: 5,954,454

[45] Date of Patent: Sep. 21, 1999

[54] OFFSHORE PLATFORM ASSEMBLY

[76] Inventor: Roy M. Bennett, 717 Old Metairie Dr., Metairie, La. 70001

[21] Appl. No.: 08/893,658

[22] Filed: Jul. 11, 1997

[30] Foreign Application Priority Data

Nov. 4, 1996 [GB] United Kingdom ..... 9622938

[51] Int. Cl.[6] ..... E02B 17/08

[52] U.S. Cl. ..... 405/199; 405/196

[58] Field of Search ..... 405/199, 198, 405/197, 196, 200, 203, 224, 227, 195.1

[56] References Cited

U.S. PATENT DOCUMENTS 2,954,676 10/1960 Guy et al. ..... 405/198

4,657,437 4/1987 Breeden ..... 405/198

5,092,712 3/1992 Goldman et al. ..... 405/196

*Primary Examiner*—David J. Bagnell

*Assistant Examiner*—Frederick L. Lagman

*Attorney, Agent, or Firm*—Garvey, Smith, Nehrbass & Doody, LLC

[57] ABSTRACT

An offshore platform assembly includes a platform 12, four legs 10 and four footings 18. Each leg 10 is coupled to the platform by upper and lower bearings which are pivotable in a direction of inclination of the legs, the upper bearing being fixed with respect to translational movements, whilst the lower bearing can slide in a plane common with the plane of the platform 12. In an alternative embodiment, the lower bearing may be fixed and the upper bearing sliding. This assembly enables the platform to be used in high waters and prevents bending of the legs, which can occur with prior art systems.

16 Claims, 5 Drawing Sheets

OFFSHORE PLATFORM ASSEMBLY

CROSS-REFERENCE TO RELATED APPLICATIONS

This application claims priority of U.K. Patent Application No. 9622938-0, filed Nov. 4, 1996, by the same inventor. That application is hereby incorporated by reference thereto.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to an offshore platform assembly known as jack-up rigs used for production, exploration drilling for oil or gas, or offshore maintenance. More particularly, the present invention relates to an offshore platform assembly with slant legs, each leg having two vertically spaced bearings in the platform resulting in reduced loading in the legs from the wind and wave forces, the increased resistance to overturning, and the reduced lateral movement of the platform.

2. General Background of the Invention

Most jack-up rig designs use straight i.e. vertical legs. The assembly uses a floatable hull with three or four tubular or latticed legs which may be circular, square or triangular. The legs support the platform in the working condition, and are supported by the platform during transit. Once the legs are located on the sea bed, elevation of the hull to the platform working height is accomplished by elevating units installed at each corner of the platform. These may be rack and pinion systems or hydraulic jacking systems which use friction clamps or pins which engage pin holes spaced at regular intervals up the legs. The jacking system couples the hull to the legs and supports the weight of the hull when elevated.

An example is shown in U.S. Pat. No. 5,092,712. The design disclosed in the '712 patent utilizes an offshore platform assembly which uses inclined legs. The legs pass through a vertical hull and the platform is elevated, flexible leg guides are adapted to move laterally, to some degree, absorbing much of the bending loads and shear forces imposed on the legs, by the use of a compressible member formed as a resilient vertical rectangular sleeve, a spring or other adjustable means which permits a limited lateral bending moment acting on the leg which passes through the guides in the platform hull.

BRIEF SUMMARY OF THE INVENTION

The present invention solves the problems in the art in a simple and straightforward manner. What is provided is an offshore platform assembly with slant legs, each leg having two vertically spaced bearings in the platform, one bearing having a laterally fixed location and a single degree of rotational freedom in the direction of the leg inclination, the other bearing having a single degree of translational freedom in the plane of the platform and a rotational degree of freedom in the direction of the leg inclination. In a preferred embodiment, the attachment of the bottom of each leg to its respective footing also allows an angular adjustment between the two. Even the fixed bearing may be laterally adjustable, but thereafter locked during the jacking process.

An additional embodiment utilizes a sliding lower leg guide installed in the four comers of the hull and a split collar guide installed in the footings which callow the hull to be jacked to its working height without bending the legs.

Therefore, it is a principal object of the present invention to provide a jack up rig assembly that utilizes a slant leg feature which is an improvement over the straight leg design due to the reduced loading in the legs from the wind and wave forces, the increased resistance to overturning, and the reduced lateral movement of the platform.

It is a further object of the present invention to provided a jack up rig assembly with no limitation placed on the working height (or air gap) which is therefore a major improvement over prior art.

It is a further object of the present invention to provided a jack up rig assembly wherein the sliding lower guide does not use springs or other resilient means to absorb loads from the leg during hull elevation and storm loading, while the rotational degree of freedom of the guides permits smooth jacking due to uniform bearing of the guides on the legs as the angle of leg inclination changes.

It is a further object of the present invention to provided a jack up rig assembly which aims to eliminate or reduce the additional loading incurred with elevation of the hull on slanted legs, with such loading, in the current state of the art, being in addition to the loads from the operational or storm design condition.

BRIEF DESCRIPTION OF THE SEVERAL VIEW OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
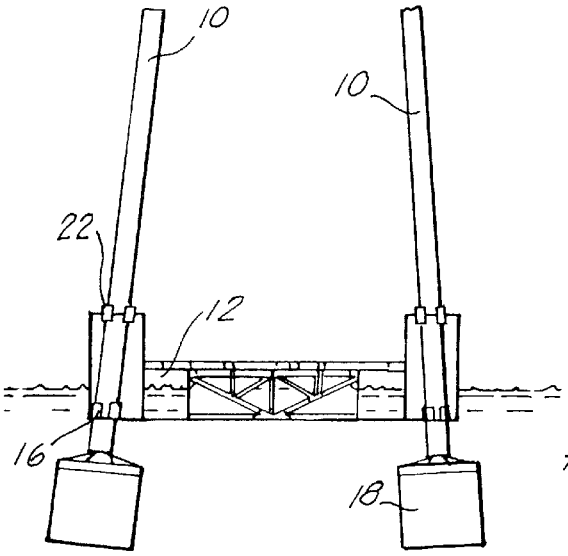
FIG. 1 shows an elevation of the platform in the transport condition with the legs fully elevated and the hull in a floating mode.
Figure 2:
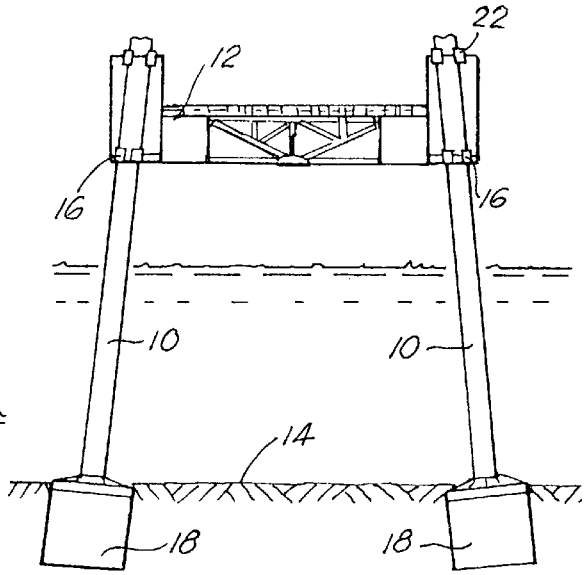
FIG. 2 shows an elevation of the platform with the hull jacked up to its working height and the footings embedded in the ocean floor.
Figure 3:
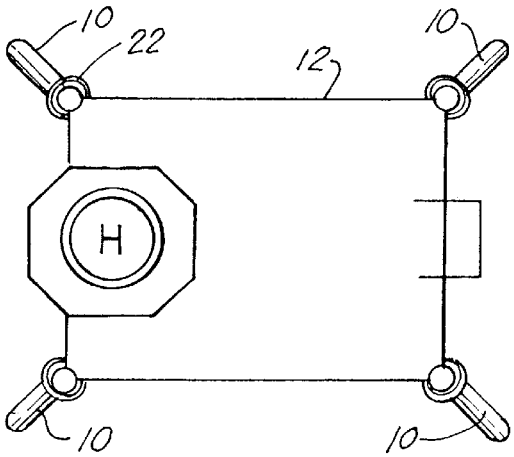
FIG. 3 shows a plan view of the platform.

The preferred embodiment of the present invention provides a jack-up platform (FIGS. 1–3) with slanting legs 10 inclined at a fixed angle of between 5 and 10 degrees which allows elevation of the hull 12 to a specified air gap above the surface of the sea without inducing bending moments in the legs.

Figure 4:
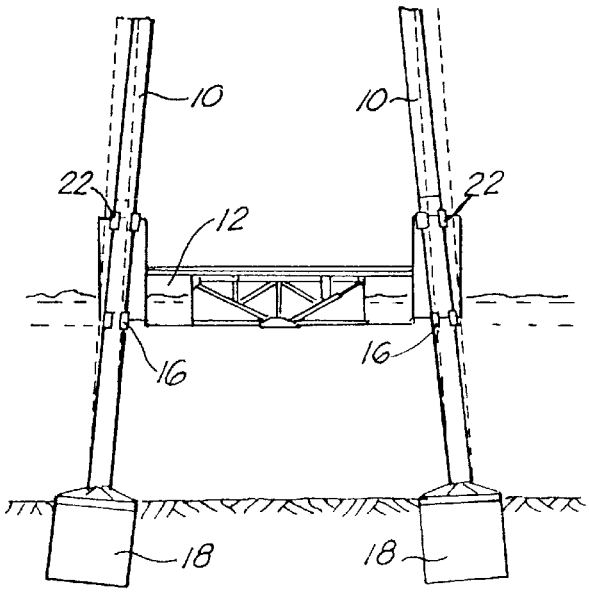
FIG. 4 illustrates the change in inclination of the legs which occur when the hull is elevated to its working height, normally about 2–3°.

Reference will now be made to FIG. 4 for discussion of the hull elevation.

The platform is towed to its location and the legs 10 are lowered to the sea bed 14. During the leg lowering phase, the sliding lower guides 16 are locked in position to ensure that the legs 10 contact the sea floor 14 at the correct angle of inclination. The locking mechanism may be mechanical or hydraulic. Penetration of the footings 18 is accomplished by extracting the water from inside the footings or by using hull ballast water.

With the legs 10 fully penetrated, the lower guide 16 locking mechanism is disengaged for the initiation of hull elevation.

Referring to FIG. 4, as the hull 12 climbs vertically, the angle of inclination of the legs 10 gradually reduces.

The present invention allows for unrestricted changes in inclination of the legs by allowing the hull lower guide to slide horizontally, and the base of the leg to pivot within a well formed in the footing. For some designs, it may be preferable to use a fixed lower guide and to adapt the upper guide to slide horizontally.

With normal air gap achieved, the lower guide 16 locking mechanism is engaged so that all legs 10 may resist loading equally due to the storm wind and wave loading. The split collar guides 20 (FIGS. 10 to 12) are installed at the top of the footing 18 well to fix the legs 10 at the sea-bed 14 which reduces the leg bending moments at the lower guide.

Figure 5:
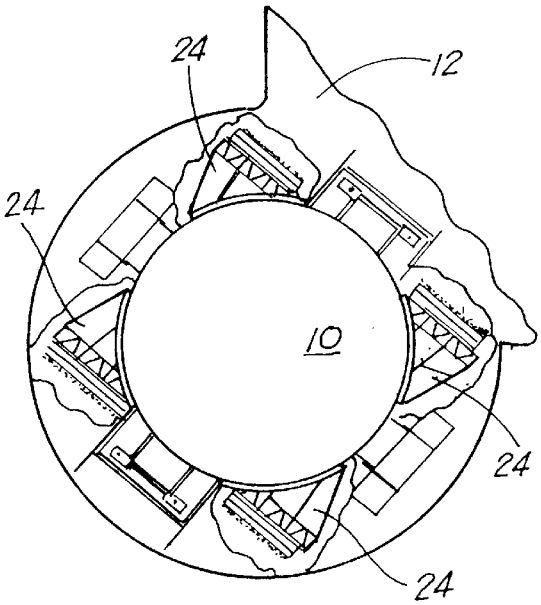
FIG. 5 illustrates one of the platform upper guides which is fixed and unable to move horizontally, but which permits pivoting movement. The four segments of the guide are shown each with their own pivot pin.
Figure 5A:
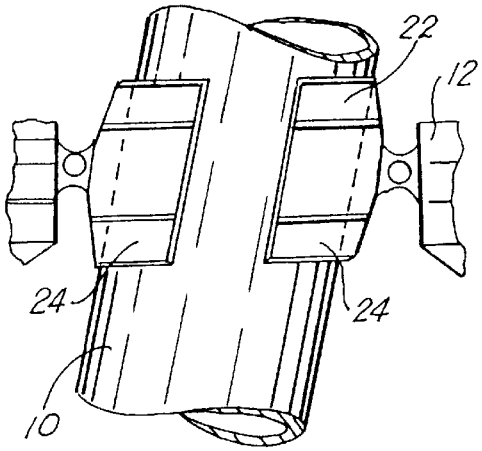
FIG. 5A is a view of the upper guide in a direction parallel to the axis of the pivot pins.
Figure 6:
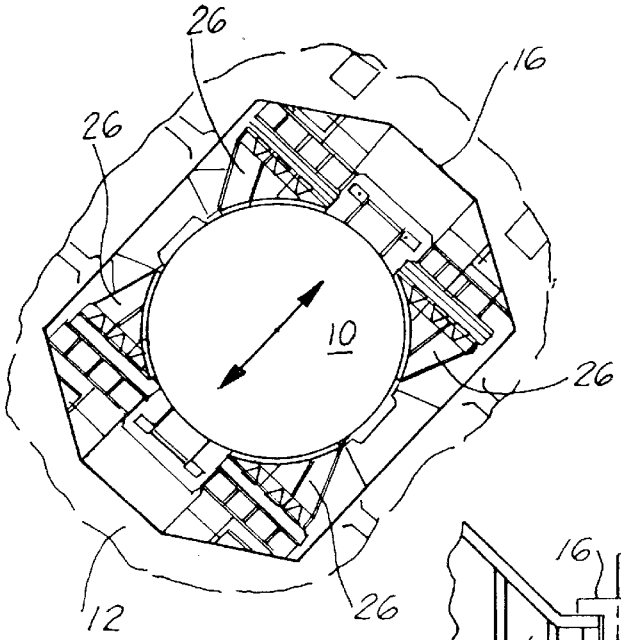
FIG. 6 is a plan view of one of the lower guides which is adapted to slide horizontally in one direction but is able to react to loads from the leg in a direction orthogonal or perpendicular to the direction of sliding.
Figure 6A:
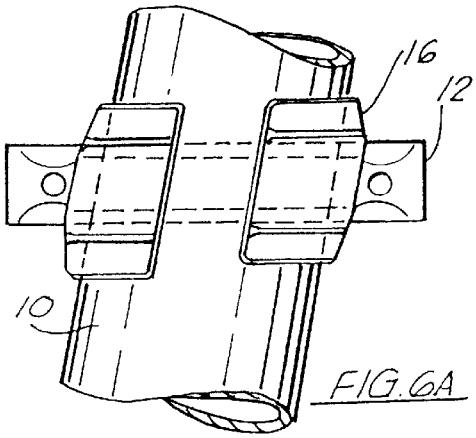
FIG. 6A is a view of one of the lower guides in a direction parallel to the axis of the pivot pins.
Figure 6B:
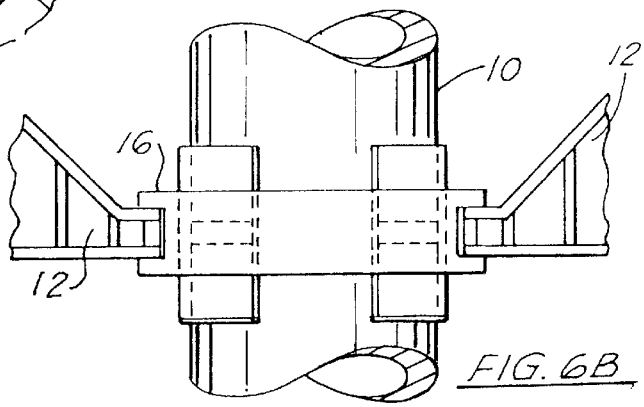
FIG. 6B is an end view of the lower guide showing the guide keyed into the hull supporting structure on each side of the guide.
Figure 6C:
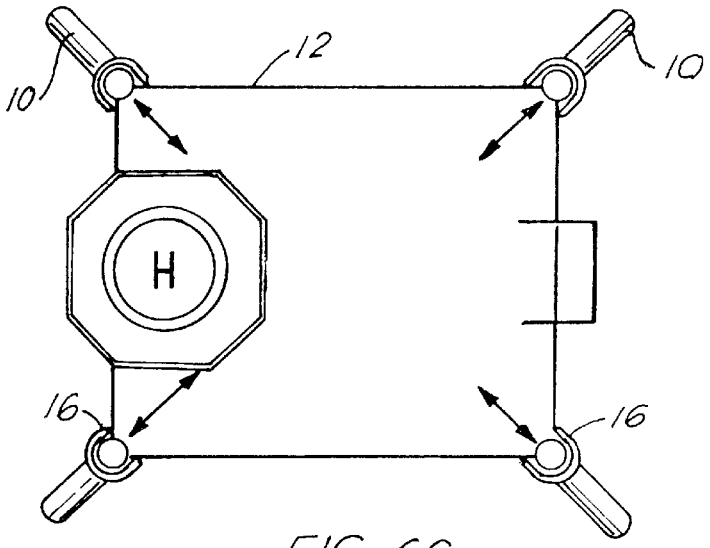
FIG. 6C shows the location of the lower leg guides on the platform comers, and their direction of movement as the platform is raised or lowered.

Referring to FIGS. 5 and 5A, the preferred structure for the upper leg guides 22 is shown. This includes four coupling members 24 pivotably connected to the platform and unable to move translationally relative thereto. The coupling members 24 hold one of the legs 10 so that it can slide therewithin and pivot along a single axis as a result of pivoting of the coupling members 24.

FIGS. 6, 6A, 6B and 6C show in detail the structure of the lower leg guides 16. This includes four coupling members 26 equivalent to the coupling members 24 of the upper guides 22. The principal difference is that the coupling members 26 are provided on a sliding mechanism, as shown by the arrow in FIGS. 6 and 6C. The amount of slide would typically be in the region of 5 to 10 inches. To assist in gliding, the sliding mechanism may be provided with friction reducing means, such as roller bearings; a friction reducing agent or with low friction surfaces. Movement of the sliding mechanism may be along a slight arc.

Figure 7:
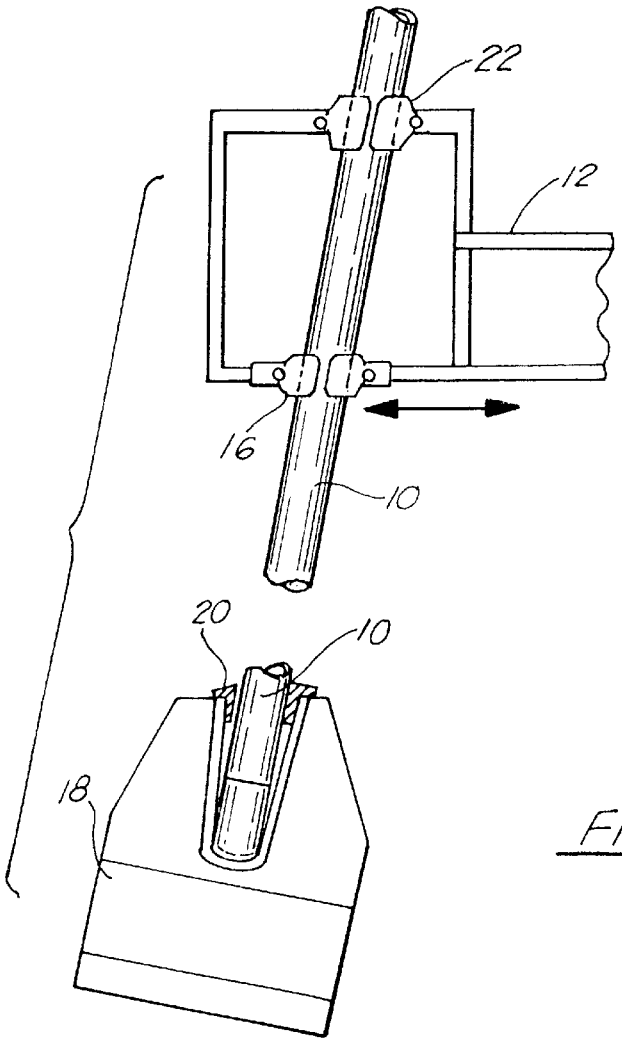
FIG. 7 shows a section cut through the platform illustrating the fixed upper and sliding lower guide, and the pivot connection at the footing.

FIG. 7 depicts how the angle of inclination of the legs 10 can be changed as a result of adjustment of the coupling mechanisms 16, 22.

Figure 8:
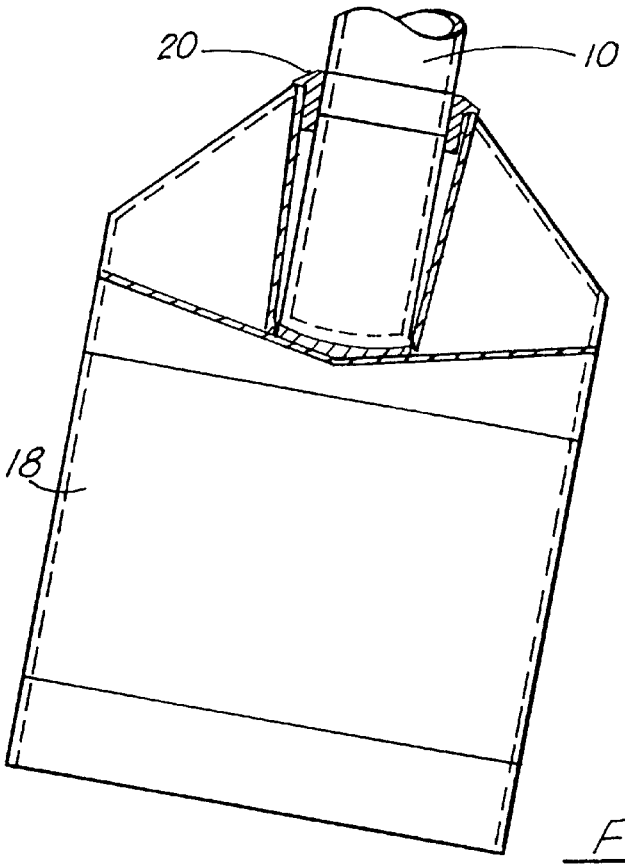
FIG. 8 shows a section cut through the leg footing.
Figure 9:
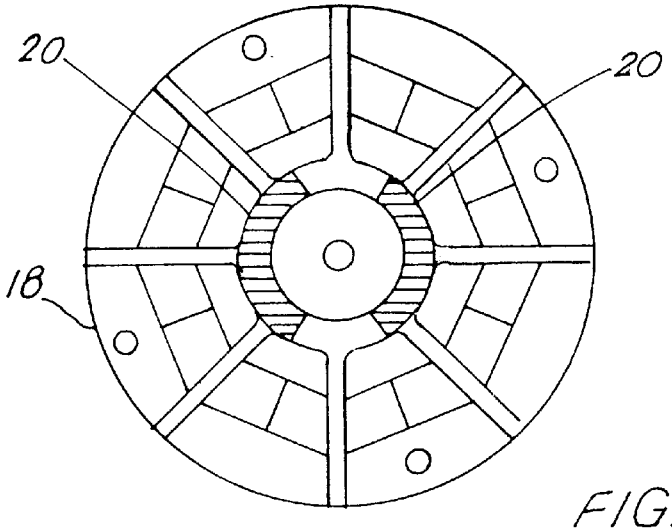
FIG. 9 shows a plan view of the leg footing.

FIG. 7 to 9 show schematically the structure of the footing 18. As will be apparent, the legs 10 are a loose fit in their respective footings, to enable the legs to pivot once the footings 19 have been secured in to the sea-bed.

Figure 10:
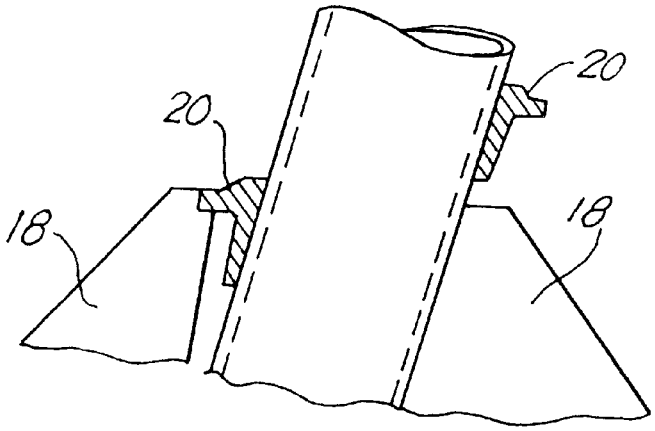
FIGS. 10, 11 and 12 show the footing split-collar guide at various states of engagement.
Figure 11:
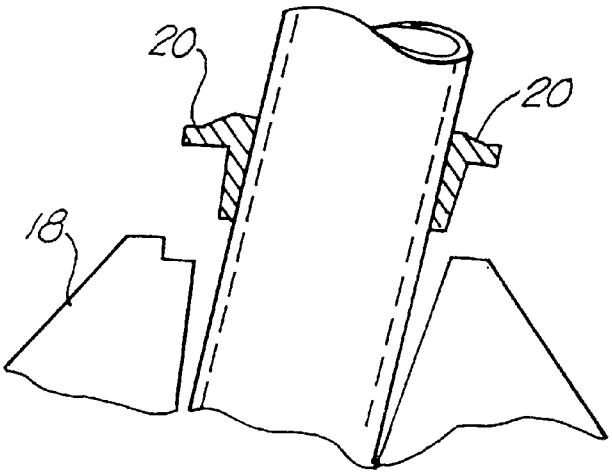
Figure 12:
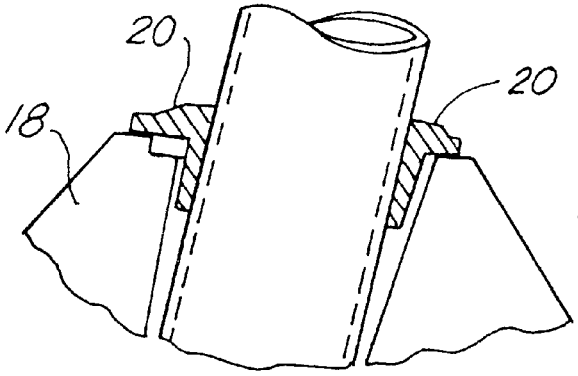

I refer now to FIGS. 10, 11 and 12.

FIG. 10 shows the left-hand segment of the split collar 20 installed in the footing well 18. The purpose of this arrangement is to ensure that the footing is correctly aligned with the leg 10 during the footing embedment operation.

FIG. 11 shows the left-hand segment retracted allowing the legs 10 to rotate unrestricted within the footing well during hull elevation.

FIG. 12 shows both segments of the split collar 20 installed in the footing well.

The present invention provides for articulation or rotation of the legs 10 as they pass through the hull 12, and also for relief from the leg rotational fixing at the leg footing connection during the jacking phase.

Jacking of the platform can be by any of the well known mechanisms. For example, there may be provided jacking pinions which co-operate with racks provided on the legs 10.

With reference to FIG. 12, the rotational fixing thereby achieved after jacking at the footing 18 assists in reducing the platform horizontal displacements and footing reactions due to overturning moments from the wind and wave forces.

In another embodiment, jack-up platforms that move frequently may have legs 10 and footings 18 integrally welded together. The bottom surface may be conical or pointed thereby avoiding high restraining movements from the supporting soil which might cause high upper guide forces whilst jacking.

In yet another embodiment, deeper water designs may employ legs 10 with pointed lower ends which simply dig into the sea bed. These are free to tilt, once engaged, as required for the jacking procedure. Once the assembly is jacked into position, anchor means may be added to each leg so as to locate the legs against lateral displacement.

In an alternative embodiment, the guides 16 and 22 provide a loose fit of the legs 10 therewithin and dispense with pivotable coupling members.

It is to be understood that various modifications and additions can be made to the above-described embodiments within the scope of the invention, which should only be interpreted in accordance with the claims.

It will be apparent that the upper and lower guides 22, 16 may be revised such that the upper guides slide and the lower guides are fixed.

The foregoing embodiments are presented by way of example only; the scope of the present invention is to be limited only by the following claims.

I claim:

1. An offshore platform assembly comprising:

a) a plurality of slant legs;

b) a platform supported by the legs and two vertically spaced bearings provided on the platform for each leg;

c) the first of said bearings having a laterally fixed location and a single degree of rotational freedom in a direction of leg inclination, the other of said bearings having a single degree of translational freedom in the plane of the platform and a rotational degree of freedom in the direction of leg inclination.

2. An offshore platform assembly according to claim 1, including a footing for each of said legs, each footing providing an amount of angular adjustment between it and its respective leg.

3. An offshore platform assembly according to claim 2, including means to fix each of said legs in position in its respective footing.

4. An offshore platform assembly according to claim 1, wherein said one of said bearings is laterally adjustable but lockable during raising or lowering of the platform.

5. An offshore platform assembly according to claim 1, wherein each of said bearings includes a plurality of guide members disposed around a respective leg and within which a respective leg can slide.

6. An offshore platform assembly comprising:

a) a plurality of slant legs;

b) a platform supported by the legs and two vertically spaced bearings provided on the platform for each leg;

c) the first of said bearings having a laterally fixed location and a single degree of rotational freedom in a direction of leg inclination, the other of said bearings having a single degree of translational freedom in the plane of the platform and a rotational degree of freedom in the direction of leg inclination; and d) a footing for each of said legs, each footing providing an amount of angular adjustment between it and its respective leg.

7. An offshore platform assembly according to claim 6, including means to fix each of said legs in position i its respective footing.

8. An offshore platform assembly according to claim 6, wherein said one of said bearings is laterally adjustable but lockable during raising or lowering of the platform.

9. An offshore platform assembly according to claim 6, wherein each of said bearings includes a plurality of guide members disposed around a respective leg and within which a respective leg can slide.

10. An offshore platform assembly comprising:

a) a plurality of slant legs;

b) a platform supported by the legs and two vertically spaced bearings provided on the platform for each leg;

c) the first of said bearings having a laterally fixed location and a single degree of rotational freedom in a direction of leg inclination, the other of said bearings having a single degree of translational freedom in the plane of the platform and a rotational degree of freedom in the direction of leg inclination; and d) one of said bearings being laterally adjustable but lockable during raising or lowering of the platform.

11. An offshore platform assembly according to claim 10, including a footing for each of said legs, each footing providing an amount of angular adjustment between it and its respective leg.

12. An offshore platform assembly according to claim 11, including means to fix each of said legs in position in its respective footing.

13. An offshore platform assembly comprising:

a) a plurality of slant legs;

b) a platform supported by the legs and two vertically spaced bearings provided on the platform for each leg;

c) the first of said bearings having a laterally fixed location, the other of said bearings having at least a degree of translational freedom laterally in the plane of the platform; and in the radial direction of leg inclination; said other of said bearings being designed to provide substantially no resistance to movement in said single degree of translational freedom when in a non-locked condition; and d) one of said bearings being lockable during raising or lowering of the platform legs.

14. The assembly in claim 13, wherein the vertically spaced bearings further comprise upper and lower bearings.

15. The assembly in claim 14, wherein either the lower or upper bearings would have a degree of translational freedom.

16. The assembly in claim 15, wherein the bearings having a degree of translational freedom would be the lockable bearings.

* * * * *